US005460093A

United States Patent [19]

Prinz et al.

[11] Patent Number: 5,460,093

[45] Date of Patent: Oct. 24, 1995

[54] PROGRAMMABLE ELECTRONIC TIME DELAY INITIATOR

[75] Inventors: Francois Prinz, San Jose, Calif.; Kent Steeves; Peter L. C. Atkeson, both of Newark, Del.; Brendan Walsh, Elkton, Md.; J. Michael Wilson, Gilroy, Calif.

[73] Assignee: Thiokol Corporation, Ogden, Utah

[21] Appl. No.: 101,237

[22] Filed: Aug. 2, 1993

[51] Int. Cl.[6] ..... F42D 1/055

[52] U.S. Cl. ..... 102/217; 102/220; 102/215

[58] Field of Search ..... 102/217, 220, 102/218, 215; 361/249

[56] References Cited

U.S. PATENT DOCUMENTS

| | | | |
|---|---|---|---|
| 2,459,556 | 1/1949 | Usselman | 179/171.5 |
| 4,136,617 | 1/1979 | Fowler | 102/206 |
| 4,145,970 | 3/1979 | Hedberg et al. | 102/218 |
| 4,233,673 | 11/1980 | Cricchi et al. | 102/276 |
| 4,445,435 | 5/1984 | Oswald | 102/215 |
| 4,487,125 | 12/1984 | Zuk | 102/206 |
| 4,496,010 | 1/1985 | Chapman, III | 102/217 |
| 4,527,636 | 7/1985 | Bordon | 102/217 |
| 4,577,561 | 3/1986 | Perry | 102/215 |
| 4,586,437 | 5/1986 | Miki et al. | 102/218 |
| 4,632,031 | 12/1986 | Jarrott et al. | 102/206 |
| 4,646,640 | 3/1987 | Florin et al. | 102/217 |
| 4,674,047 | 6/1987 | Tyler et al. | 102/206 |
| 4,708,060 | 11/1987 | Bickes, Jr. et al. | 102/202.7 |
| 4,712,477 | 12/1987 | Aikou et al. | 102/206 |
| 4,730,558 | 3/1988 | Florin et al. | 102/218 |
| 4,819,560 | 4/1989 | Patz et al. | 102/202.5 |
| 4,825,765 | 5/1989 | Ochi et al. | 102/206 |
| 4,843,964 | 7/1989 | Bickes, Jr. et al. | 102/202.5 |
| 4,869,170 | 9/1989 | Dahmberg et al. | 102/202.5 |
| 4,893,564 | 1/1990 | Ochi et al. | 102/206 |
| 4,984,519 | 1/1991 | Ochi et al. | 102/217 |
| 5,117,756 | 6/1992 | Goffin, II | 102/218 |

FOREIGN PATENT DOCUMENTS

| | | | |
|---|---|---|---|
| 2571843 | 4/1986 | France | 102/218 |

*Primary Examiner*—Stephen M. Johnson

*Attorney, Agent, or Firm*—Madson & Metcalf; Ronald L. Lyons

[57] ABSTRACT

A programmable electronic time delay initiator includes a digital time-delay circuit that counts in response to a dual-resonator clock and, at the end of the programmed time delay, gates the pre-stored charge on a capacitor to a semiconductor bridge initiator to fire an explosive. The timer circuit includes a combined crystal/RC oscillator that provides high accuracy oscillations from the crystal or oscillations from the RC components in the event the crystal fails. The timer circuit functions in response to multi-part serial commands delivered on a conventional two-wire path. The timer is initially powered-on to provide power to a capacitor that supplies power to the time-delay and related circuits. An initial ATTENTION pulse initializes the circuitry and starts a watchdog timer that counts a fixed number of clock cycles and resets the logic if a following WRITE, ARM, or FIRE command is not received. A WRITE pulse and following programming pulses programs a fusible link memory with time-delay information, an ARM pulse effects charging of a firing-charge capacitor, and a FIRE pulse gates the firing-charge to the bridge initiator to fire the explosive.

33 Claims, 9 Drawing Sheets

PROGRAMMABLE ELECTRONIC TIME DELAY INITIATOR

BACKGROUND OF THE INVENTION

The present invention relates to programmable electronic time delay initiators, and, more particularly, to high-reliability and high-accuracy programmable initiators for detonating explosive charges.

The efficient use of explosives in mining operations and the demolition of structures often requires that many charges be placed in a predetermined pattern. In order to minimize ground vibration and increase yields in mining operations and to precisely control demolition, it is common to detonate the individual charges in a timed sequence. Failure to detonate in the precise sequence can cause undue ground vibration, undesired or excessive fly-rock, and, in a demolition context, collateral damage. In general, timed detonation can be accomplished by detonators that use pyrotechnic delays, sequential-type blasting machines, and electrically programmable detonators.

Pyrotechnically delayed detonators use the equivalent of a fuse column to produce a time delay between the moment of ignition and the detonation of the explosive charge. In general, pyrotechnically delayed detonators are not field programmable and the accuracy of the time delay is dependent upon manufacturing standards and may be further affected by aging and the environmental temperature of the device at ignition. In addition, the vibration or blast effect of the first-fired charge can interrupt the circuit to later-fired charges and, accordingly, result in circumstances in which unexploded charges are mixed in the debris produced by the earlier fired charges.

Electronically programmable detonators are known in which an electronic oscillator produces clock pulses that are counted and compared to a predetermined time-delay limit. When the pulse count equals the count limit, a signal gates an appropriate current to a bridge initiator, for example, a bridgewire or semiconductor bridge, to effect detonation. Because of their digital nature, such devices can provide a reasonable level of accuracy. The programmable detonators, however, are sensitive to the ground vibration caused by earlier detonations. For example, it is known to use a quartz crystal as the oscillation source since such crystals can provide highly accurate clock pulses. However, the crystals are piezoelectric devices and a shock wave from an earlier detonation in the sequence of detonations can cause the crystal to momentarily or permanently cease oscillation. A momentary cessation of oscillation will result in a further delay in detonation with the last-firing detonator being subject to the adverse effects of all the preceding detonations. In a worst-case scenario, the oscillation-providing crystal can undergo catastrophic fracture resulting in a no-fire condition for the affected charges. As can be appreciated, a dangerous condition exists when unexploded charges are part of the debris caused by the preceding and succeeding charges in the firing sequence.

In the demolition context, reliable timing is of particular concern since damage to adjacent structures must be minimized. In these situations, the total explosive charge is divided into many smaller charges that are strategically placed throughout the structure to be demolished. Since vibration must be minimized, the many individual charges must be detonated in a precise sequence to achieve the desired demolition pattern. Any deviation in timing or timing errors induced in a particular initiator by a preceding blast can result in a suboptimal result. In the mining context, reliable timing can minimize ground vibration, dust, and fly-rock. Since some quarries and mining operations are adjacent populated areas, suboptimal blasting can result in license suspensions or revocations, damage claims, or fines.

SUMMARY OF THE INVENTION

In view of the above, it is an object of the present invention, among others, to provide a programmable electronic time delay initiator in which the time delay can be programmed at any time from initial manufacture to use in the field.

It is another object of the present invention to provide a programmable electronic time delay initiator having a highly accurate clock that is relatively immune to timing perturbations caused by vibration and/or shock from preceding explosions.

It is still another object of the present invention to provide a programmable electronic time delay initiator having a piezoelectric resonator as the source of clock pulses in which clock pulses will continue in the event that the piezoelectric resonator ceases to function, for example, because of vibration or shock.

It is a further object of the present invention to provide a programmable electronic time delay initiator in which the programming, arm, and fire functions can be accomplished with a two-wire input.

It is a still further object of the present invention to provide a programmable electronic time delay initiator that is relatively immune to spurious, stray, or unplanned voltage inputs as well as pin-to-pin and pin-to-case electrostatic discharge.

It is an additional object of the present invention to provide a programmable electronic time delay initiator in which the command-signal protocol is relatively immune to spurious electromagnetic interference.

In view of these objects, and others, the present invention provides a programmable electronic time delay initiator that can be programmed in accurate time increments for initiating explosives in a controlled sequence. The timing function includes fail-operational features by which the adverse effect of vibration and shock are minimized. In its most general form, an initiator, such as a semiconductor bridge initiator, is integrated with a secondary explosive and connected to a programmable electronic time-delay circuit that is responsive to write, arm, and fire commands to initiate the explosive at the desired time. In the event of a mis-signal or an invalid-signal condition, the initiator will transition to a disarm state while awaiting valid command signals.

In the preferred embodiment, the time-delay circuit includes digital timing functions and a capacitor that holds a charge sufficient to fire the bridge initiator. The timer circuit includes a source of clock pulses derived from the operation of a piezoelectric resonator, such as a quartz or ceramic crystal, and a cooperating RC impedance circuit. The piezoelectric resonator provides high-accuracy clock pulses for system timing while the RC oscillator circuit also resonates in synchronism with the piezoelectric resonator. In the event that vibration or shock interrupts the operation of the piezoelectric resonator, for example, by momentarily halting the piezoelectric resonator, the RC oscillator will continue to deliver clock pulses until the piezoelectric resonator recovers synchronism. In a worst-case situation, i.e., where the vibration or shock fractures or otherwise destroys the piezoelectric resonator, the RC oscillator circuit will continue delivery of clock pulses until the timing circuit fires the initiator.

The timer circuit functions in response to serial commands delivered on a conventional two-wire path. The timer is initially powered-on to provide power to a capacitor that supplies power to the time-delay and related circuits. An initial ATTENTION pulse initializes various bistate and logic devices and starts a counter that counts a fixed number of clock cycles. If a following pulse is not received within the fixed number of clock cycles after the ATTENTION pulse, the timer self-resets to minimize the probability of extraneous EMI being mis-interpreted as a command pulse. If a WRITE pulse is received during a predetermined clock cycle subsequent to the ATTENTION pulse, the circuit is configured to accept programming pulses within one of n possible clock cycles after the WRITE pulse. The presence of a programming pulse in a selected clock cycle subsequent to the preceding WRITE pulse will cause a fusible link in a memory to open to effectively program the desired time delay. If an ARM pulse is received in a predetermined clock cycle subsequent to the ATTENTION pulse, the circuit is configured to charge a firing-charge supply capacitor with sufficient energy to fire the bridge initiator, preferably a semiconductor bridge initiator. Lastly, if a FIRE pulse is received within a preselected FIRE clock-cycle, the circuit is configured to disconnect and isolate the timer from its two-wire input, start the count cycle that determines the programmed time delay using power from the previously charged circuit power supply capacitor, and, at the end of the programmed time delay, discharge the energy stored in the firing capacitor into the bridge to then initiate the explosive/pyrotechnic. The particular sequence of the ATTENTION, WRITE, ARM, and FIRE pulses allows for the control of the initiator in such a way that possible mis-commands from EMI or other sources are minimized.

The present invention advantageously provides a programmable electronic time delay initiator in which the time delay can be programmed at any time from manufacture to use in the field using a serial command-and-control pulse protocol that can be delivered over a two-wire pathway.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 3A is the first portion a flow diagram of the command functions of the programmable electronic time delay initiator;

FIG. 3C illustrates the manner in which FIGS. 3A and 3B are to be read;

DESCRIPTION OF THE PREFERRED EMBODIMENT

Figure 1:
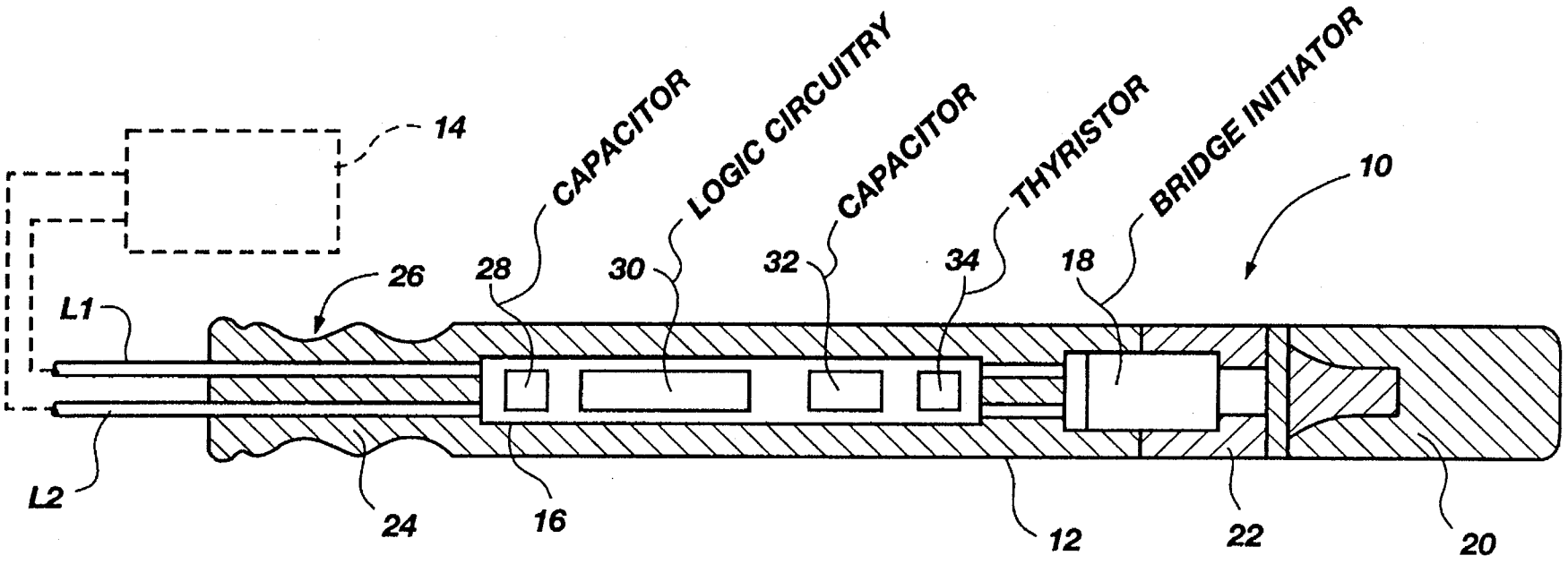
FIG. 1 is a side view, in cross-section, of a representative programmable electronic time delay initiator in accordance with the present invention.

A programmable electronic time delay initiator in accordance with the present invention is shown in FIG. 1 and designated generally therein by the reference character 10. As shown, the initiator 10 is an elongated, closed-end cylindrical housing 12 with input leads L1 and L2 extending from one end of the housing 12. The input leads L1 and L2 are connected to a blasting machine 14 (dotted-line illustration) which provides command signals to the initiator 10, as explained below. A circuit board 16, a bridge initiator 18, and an explosive charge 20 are located within the housing 12. The two wire leads, L1 and L2, connect directly to the circuit board 16, which, in turn, is electrically connected to the bridge initiator 18. Additionally, a spacer structure 22 is mounted between the bridge initiator 18 and the explosive charge 20. The circuit board 16, which includes the time-delay circuitry, and the bridge initiator 18 are preferably encapsulated with an elastomeric material 24, such as a silicone, to provide vibration and environmental protection. The housing 12 is typically a metal cylinder 6 to 8 mm. in diameter and from 60–100 mm. in length. As shown on the left side of the housing 12 in FIG. 1, the housing 12 wall is crimped to form a circumferential seal 26. The wire leads L1 and L2 are connected to the blasting machine 14 which supplies operating power and issues various commands as explained below. The blasting machine 14 can include a microprocessor (not shown) and related circuitry that can be programmed to provide command signals in accordance with the command-signal protocol described below. In the preferred embodiment, the bridge initiator 18 is a semiconductor bridge of conventional design and includes a bridge structure of a heavily doped semiconductor to provide a current path that is typically heated to a plasma by a current flow in response to a FIRE command. In the preferred embodiment, the bridge initiator 18 is of the type disclosed in U.S. Pat. No. 4,708,060 issued Nov. 24, 1987 and entitled "Semiconductor Bridge (SCB) Igniter," the disclosure of which is incorporated herein by reference. The explosive charge 20 is of conventional design and abuts the bridge initiator 18 in an operative relationship, that is, the bridge initiator 18 will cause the explosive charge 20 to initiate upon application of a sufficient current through the bridge initiator 18. The explosive charge 20, once initiated, functions to initiate the main explosive charge or an intermediate first-fire explosive that, in turn, initiates the main explosive charge.

The time-delay circuitry, as explained in more detail below, includes a circuit-power supply capacitor 28 that accepts a charge sufficient to power the logic circuitry 30 during its operating cycle and another, larger firing-charge supply capacitor 32 that accepts a charge sufficient to drive the bridge initiator 18. In addition, the time-delay circuitry includes a command signal discriminator (not shown in FIG.

1) that is responsive to ATTENTION, WRITE, ARM, and FIRE commands, and a thyristor, such as an SCR 34, that functions to discharge the energy stored in the firing capacitor 32 into the bridge initiator 18. All commands are transmitted over the two input wire leads L1 and L2 in a serial digital format as shown by the timing diagram of FIG. 2 and the functional flow diagram of FIGS. 3A and 3B.

Figure 2:
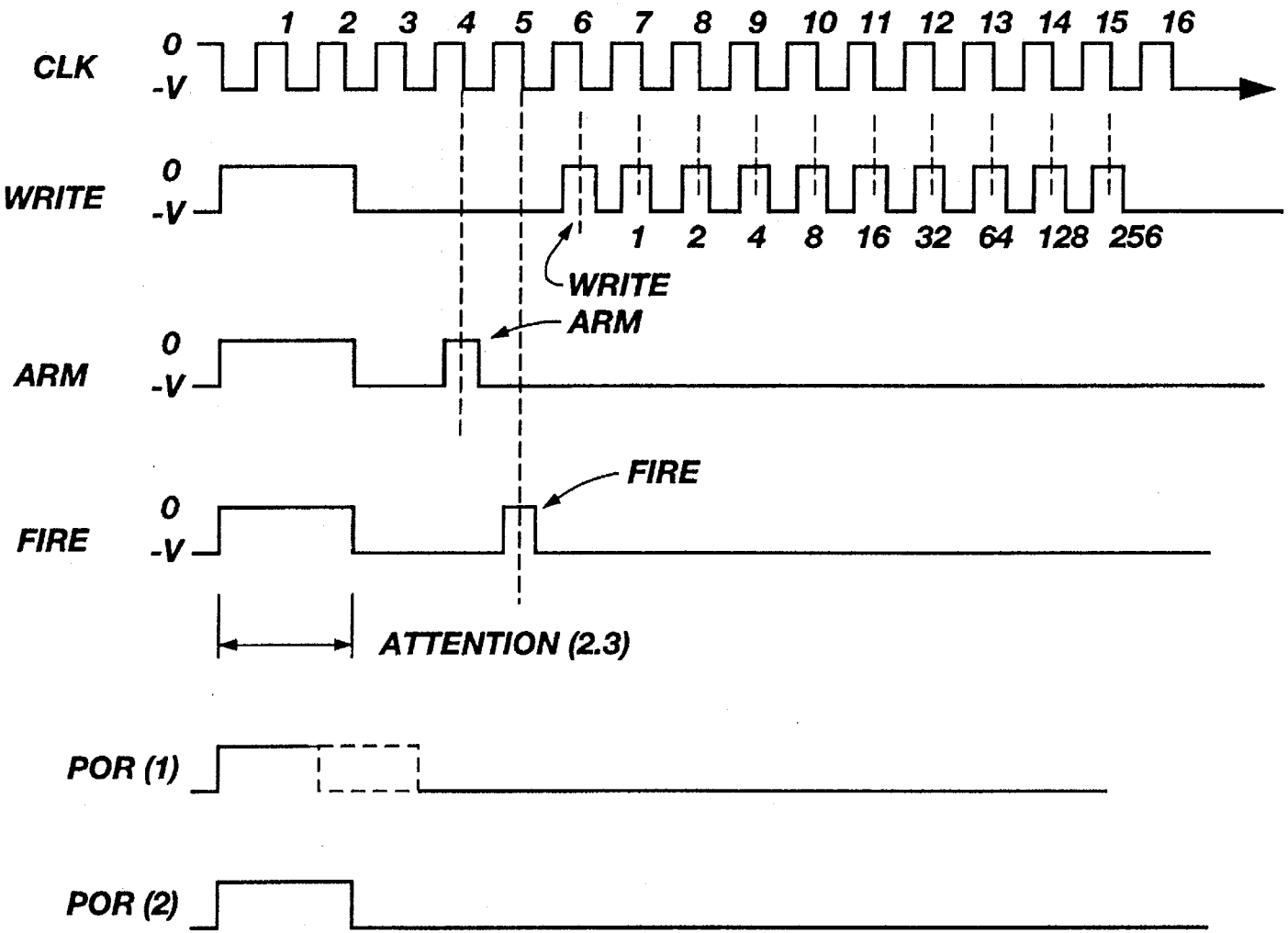
FIG. 2 is a timing diagram illustrating the command-pulse protocol for operation of the programmable electronic time delay initiator and two conditions causing a power-on reset of the initiator.
Figures 3A, 3B, 3C:
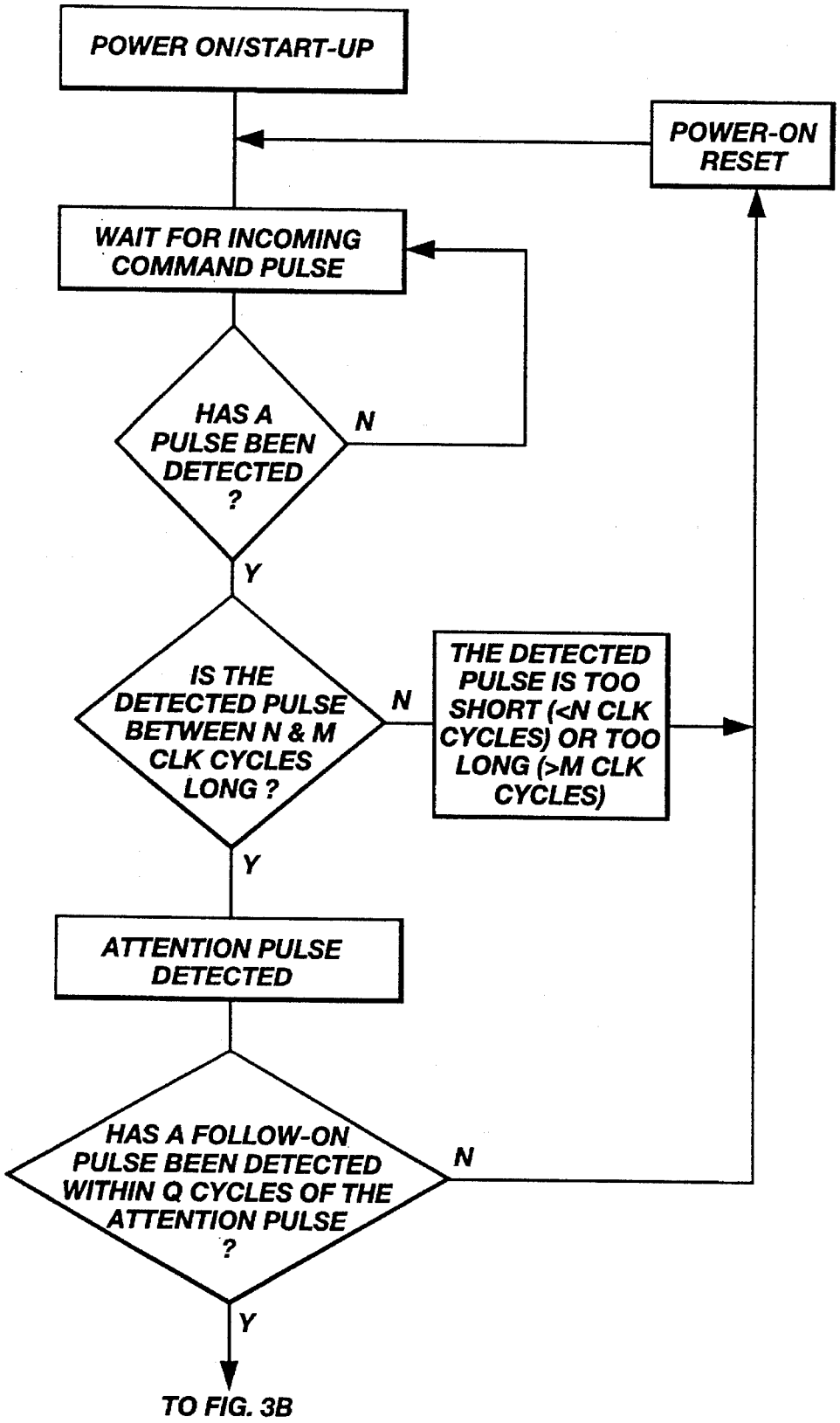

As shown in FIG. 2, the time-delay circuitry is operated under control of a sequence of recurring equispaced clock pulses CLK, which, in the preferred embodiment, are provided to the CLK-responsive logic circuitry 30 at a rate of 1024 pulses/second (i.e., 1 kHz). The CLK pulses are generated in response to the application of the −V supply power to the time-delay circuitry through the two input leads L1 and L2. The power-on state (FIG. 3A) also functions to charge the circuit-power supply capacitor 28, as explained more fully below, that serves to power the time-delay circuitry after the FIRE command is received. The time-delay circuitry is preconditioned to receive one of its WRITE, ARM, or FIRE commands by an initial ATTENTION pulse which, as shown on the left of the WRITE, ARM, or FIRE lines in FIG. 2, is a pulse represented by a transition from the initially applied −V volts to zero for a selected time period followed by a return to the −V volt level. In the preferred embodiment, the ATTENTION pulse is 2.3 milliseconds in duration and must be more than n CLK pulses and less than m CLK pulses in duration. Any pulses appearing on the input wires L1 and L2 having a duration of less than n CLK cycles or more than m CLK cycles will not be recognized as a valid ATTENTION pulse and will not precondition the circuitry for reception of a subsequent WRITE, ARM, or FIRE command pulse. As shown in FIG. 3A and as represented by the condition POR(1) in FIG. 2, an incoming pulse that is too short or too long will cause a power-on reset (POR) by which the functional control is reconditioned to await another ATTENTION command. As part of the power-on reset, any charge in the firing capacitor 32 is intentionally discharged through a controlled impedance to disable the time-delay circuitry. In the preferred embodiment, n=2 and m=3, i.e., the ATTENTION pulse must be more than two-clock pulses long and less than three-clock pulses long (i.e., 2.3 clock pulses being preferred). The ATTENTION pulse is sufficiently long so that pulses generated by EMI, RFI, or ESD energy will have a low probability of being misinterpreted as a valid ATTENTION pulse.

As shown in FIGS. 3A and 3B, any pulse subsequent to the ATTENTION pulse received between m and q CLK cycles is tested to determine if that pulse is a WRITE, ARM, or FIRE pulse. If no pulse subsequent to the ATTENTION pulse is detected within q CLK cycles of the ATTENTION pulse, the time-delay circuitry is subject to a power-on reset as represented by the condition POR(2) in FIG. 2. In the preferred embodiment, q=6; the six-CLK cycle "window" subsequent to the valid ATTENTION pulse further minimizes the probability of EMI, RFI, or ESD energy causing a spurious ATTENTION pulse of the preselected duration followed by another spurious pulse within the time-window (i.e., CLK cycles m through q subsequent to the ATTENTION pulse) that corresponds to a WRITE, ARM, or FIRE command. If a pulse is detected subsequent to the ATTENTION command within the proper timing context for a WRITE, ARM, or FIRE command, the functional-flow branches along an appropriate pathway as shown in FIG. 3B.

The WRITE pulse is sent six CLK cycles after the beginning of the ATTENTION pulse and, when detected, the circuitry awaits programming pulses during the next p successive CLK cycles (FIG. 2). In the preferred embodiment, the time-delay circuitry is designed to offer a maximum delay of 512 CLKS with the delay programmable in one-CLK increments. A nine-bit binary word provides the necessary 1-of-512 incremental values. As shown in dotted-line in FIG. 2 and, as shown on the left in FIG. 3, up to nine successive programming pulses can be detected during the next nine successive CLK positions representing the binary values corresponding to bit-weights of 1, 2, 4, 8, 16, 32, 64, 128, and 256. As explained more fully below, the presence of a programming pulse in any one of the nine successive CLK positions will cause a memory element to change state to thereby program the corresponding bit in the time-delay memory. In the preferred embodiment, the presence of a programming pulse will cause a corresponding fusible link in the time-delay memory to be opened in response to the flow of a momentary programming current. After the timing memory is programmed, the time-delay circuitry returns to a wait state, awaiting an ATTENTION command followed by an ARM command.

The time-delay circuitry can be reset at any time by sending an ATTENTION pulse without a following WRITE, ARM, or FIRE command to cause a power-on reset as represented by the condition POR(2) in FIG. 2. In the event power is removed from the time-delay circuitry, any charge on the firing capacitor 32 will be discharged.

As shown in FIG. 2, the ARM command can be sent four CLKS after the beginning of a valid ATTENTION command and, when detected, the time-delay circuitry applies a full charge to the firing capacitor 32 and concurrently reads the memory in the firing counter, as explained more fully below. Since the firing capacitor 32 will draw current when charging is initiated, the current draw can be monitored by the blasting machine 14 to determine when the firing capacitor 32 is fully charged.

Figure 3B:
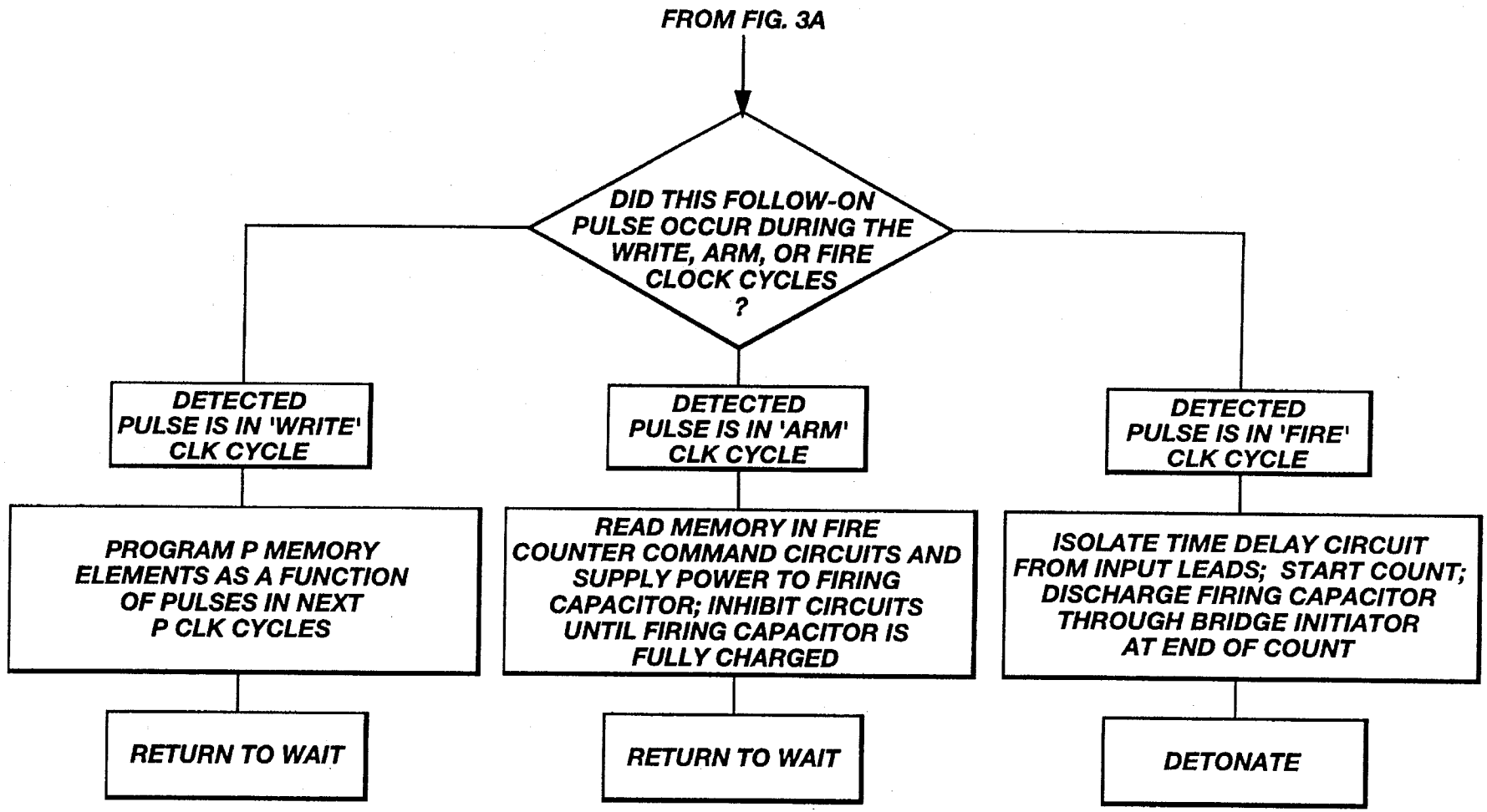
FIG. 3B is the second portion a flow diagram of the command functions of the programmable electronic time delay initiator.

The FIRE command can be sent five CLKS after the beginning of a valid ATTENTION command and, when detected and as shown in FIG. 3, the time-delay circuitry isolates itself from its input signals and begins counting CLK pulses until the programmed time delay has elapsed at which time a trigger signal is issued to the switching device (i.e., the SCR 34) to gate the energy stored in the firing capacitor 32 to the bridge initiator 18. The time-delay circuitry desirably isolates itself from its input lines to prevent any stored electrical energy within the time-delay circuitry from being discharged into or through the input leads.

The control sequences shown in FIG. 3B can be performed in a low-voltage test mode at the factory or in the field as a way of verifying circuit integrity prior to actual detonation. In this low-voltage test mode, the circuitry is operated a voltage that is a fraction of the normal operational voltage and which is insufficient to effect detonation; however, the circuitry is nonetheless cycled through its various states as a way of verifying unit integrity.

The time-delay circuitry can be implemented by hardware logic devices, by stored-programmed controlled processing, or a combination of both. In the preferred embodiment and as shown in the block diagram of FIG. 4, the time-delay circuitry is principally implemented by hardware logic in the form of an ASIC with the various command signals discriminated by a series of edge-triggered D-type flip-flops configured as counters or shift registers that change state in response to the system clock and at least one other input.

Figure 4:
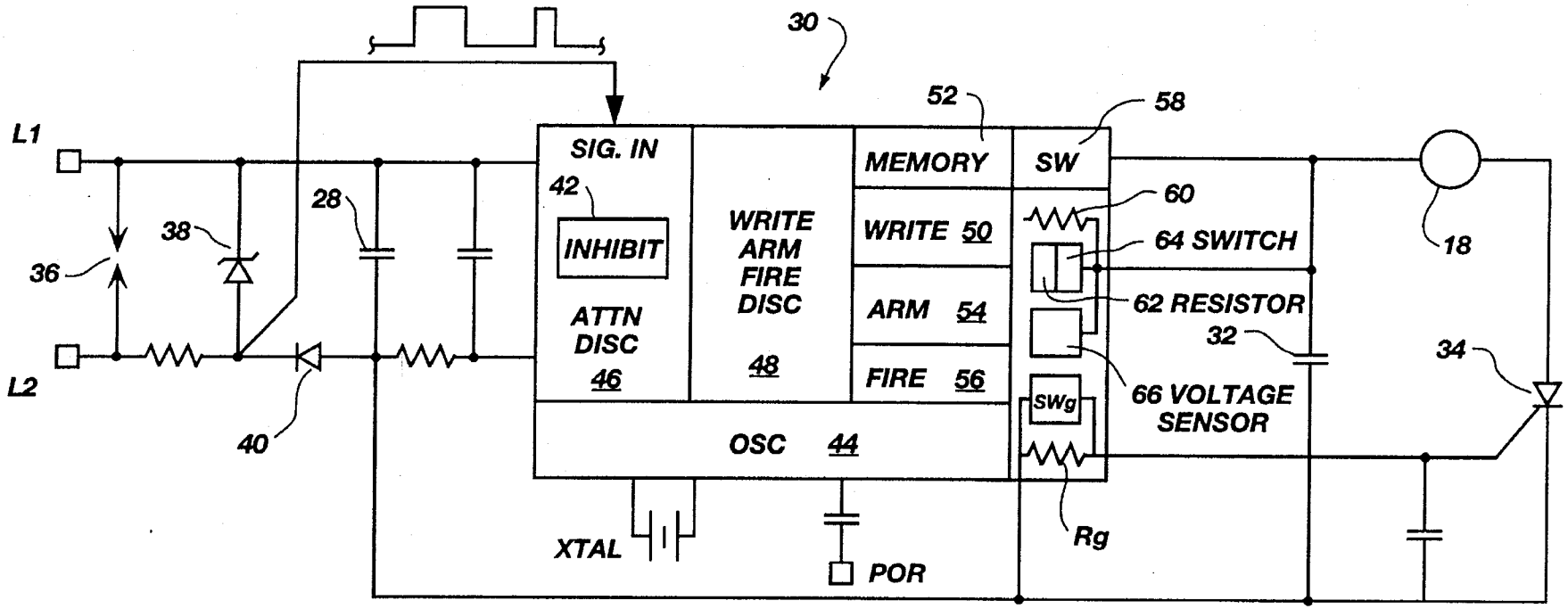
FIG. 4 is an overall block diagram of the time-delay circuit of the present invention.

As shown in FIG. 4, the input L1 and L2 are shunted by a spark gap 36 that functions to shunt any electrostatic or other high voltages that appear on the input leads and a zener diode 38 that limits the operating voltage presented to the logic circuitry 30 to about minus 22 VDC, in the case of the preferred embodiment. A blocking diode 40 functions in a spurious signal suppression role to block power to the logic circuitry 30 in the event of a mis-polarized connection to the power and the command signal source. The circuit-power supply capacitor 28 is connected to accept a charge sufficient to power the logic circuitry 30 after the FIRE command is received, and an inhibition circuit 42 is connected in the signal path to selectively disconnect and isolate the logic circuitry 30 subsequent to a FIRE command. In the preferred embodiment, the inhibition circuit 42 is formed on the ASIC that defines the logic circuitry 30.

The logic circuitry 30 includes, as shown in schematic block form, a dual-resonator oscillator 44 that provides clock pulses, an attention-pulse discriminator 46 that tests any received pulses to determine if that pulse is a valid ATTENTION command, a write/arm/fire discriminator 48 that determines if pulses subsequent to a valid ATTENTION command are a WRITE, ARM, or FIRE command, a memory programming (write) circuit 50, a memory 52 that is programmed by the memory programming circuit 50, an arming circuit 54 that effects charging of the firing capacitor 32, and a fire-command circuit 56 that triggers a SCR 34. The firing capacitor 32, which can take the form of a plurality of parallel-connected subcaps (not shown), is connected through a switch 58 in circuit with the series-connected SCR 34 and the bridge initiator 18. The switch 58 allows the firing capacitor 32 to be selectively connected and disconnected from the supply voltage. In the preferred embodiment, the firing capacitor 32 is a 60–80 μf capacitor and with a bleed resistor 60 being provided and having a 1-megohm value. The SCR 34 will switch any charge in the firing capacitor 32 through the bridge initiator 18 in response to an appropriate trigger signal applied to the gate of the SCR 34. In addition, a series-connected rapid-discharge resistor 62 and a discharge switch 64 shunt the firing capacitor 32 to quickly discharge the firing capacitor 32 when a disarmed state is desired, i.e., when a pulse is sensed that is too long or too short to be a valid ATTENTION pulse (i.e., POR1, FIG. 2) or when a valid ATTENTION pulse is sensed without a subsequent WRITE, ARM, or FIRE pulse (i.e., POR2, FIG. 2). A voltage sensor 66 is connected across the firing capacitor 32 and, in the preferred form, provides a signal indicating that the firing capacitor 32 is at-voltage or not at-voltage. A 'not at-voltage' signal is available to inhibit the fire circuitry. The gate of the SCR 34 is connected through a gate resistor $R_g$ with a selectively acutatable clamping switch $SW_g$ (i.e., a MOSFET) in parallel circuit with the gate resistor $R_g$. In its ON state, the clamping switch $SW_g$ has a substantially lower impedance than the gate resistor $R_g$ to thereby gate the SCR 34.

Figure 5:
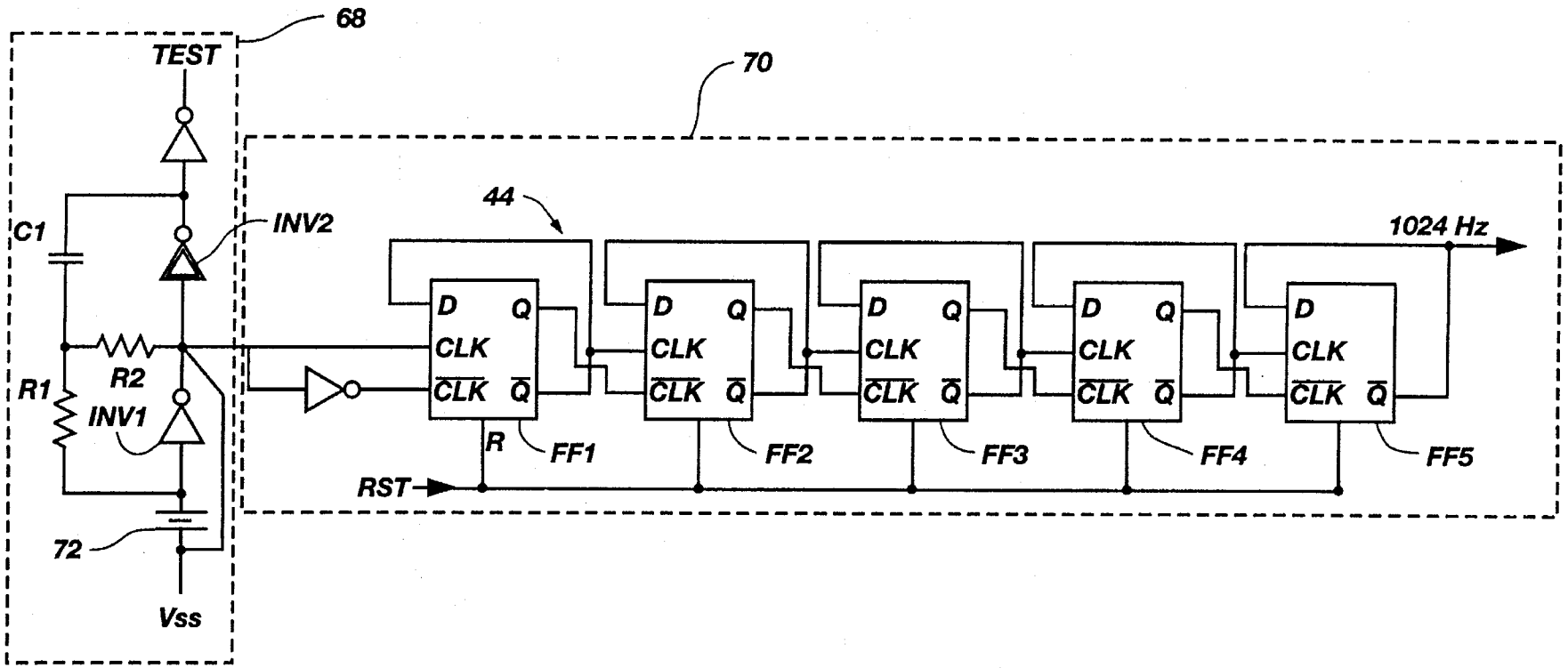
FIG. 5 is a schematic diagram of the dual-resonator oscillator for providing clock pulses to the time-delay circuit.

The dual-resonator oscillator 44 is shown in greater detail in FIG. 5 and includes, as shown, an oscillator circuit 68 and a five-stage divider 70 that divides-down the oscillations provided by the oscillator circuit 68. The oscillator circuit 68 includes serially connected inverters INV1 and INV2 with an output-to-input feedback path defined by a capacitor C1 and a resistor R1 and another resistor R2 connected between the capacitor C1 and the resistor R1 to the node connecting the inverter INV1 to the inverter INV2 node, this latter node providing the oscillation output to the five-stage divider 70. In the preferred embodiment, the inverter INV2 is a 'doubled' inverter (i.e., paralleled) to provide reduced impedance through the inverter INV2. The output of the inverter INV2 can be connected to a test pad though another inverter (unnumbered). A crystal 72 is connected in parallel with the inverter INV1 input and output. The impedances of the RC components are chosen to provide a resonant frequency that is the same as or a fundamental of the frequency of the crystal 72. In the preferred embodiment, the crystal 72 is of the type designed to withstand high-G environments (i.e., 30,000 g's), has a fundamental frequency of 163.840 kHz, and functions as the driver that synchronizes the two inverter stages INV1 and INV2.

The use of an oscillator circuit 68 with both an RC resonator and a high-accuracy piezoelectric crystal 72 provides for a measure of redundancy in the event that operation of the crystal 72 is momentarily or permanently interrupted by the shock waves or vibration of a preceding explosion. It is possible, though unlikely, that a crystal oscillator circuit can cease operation for one or more oscillations in response to a shock or pressure wave from a nearby explosion. The combination of the crystal 72 and the RC circuit in the initiator environment allows the RC circuit to continue to provide oscillations in the event operation of the crystal 72 is momentarily halted. The RC circuit will continue to provide oscillations to the logic circuitry 30 and assist in resynchronizing the operation of the crystal 72. In an unlikely worst-case scenario, the crystal 72 may be fractured from a shock pulse. In this situation, the RC circuit will continue to supply oscillations to ensure that the time-delay circuitry will function. The preferred crystal is available under the P/N CX-2H5-02 designation from the Statek Corp., 512 No. Main St., Orange, Calif. 92668.

The five-stage divider 70 is organized as five cascaded D-type flip-flops FF1, FF2, FF3, FF4, and FF5 that accept the oscillations from the oscillator circuit 68 and divide those oscillations down to a 1024 Hz CLK output that clocks the remaining circuits of the logic circuitry 30, as is conventional in the art. The reset inputs of the flip-flops are connected in common so that the five-stage divider 70 can be selectively inhibited or enabled.

Figure 6:
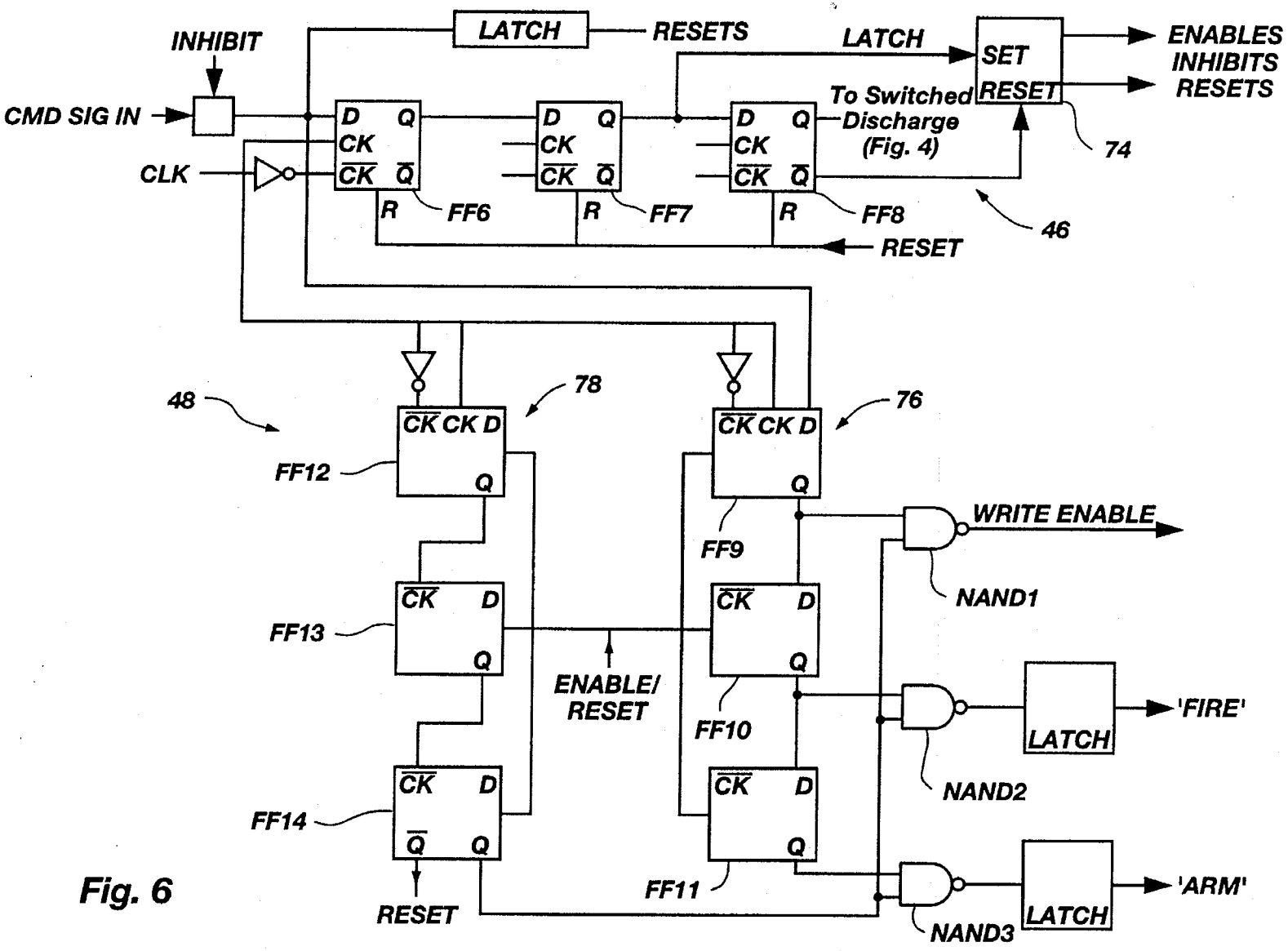
FIG. 6 is a schematic diagram of command pulse discriminators.
Figure 7:
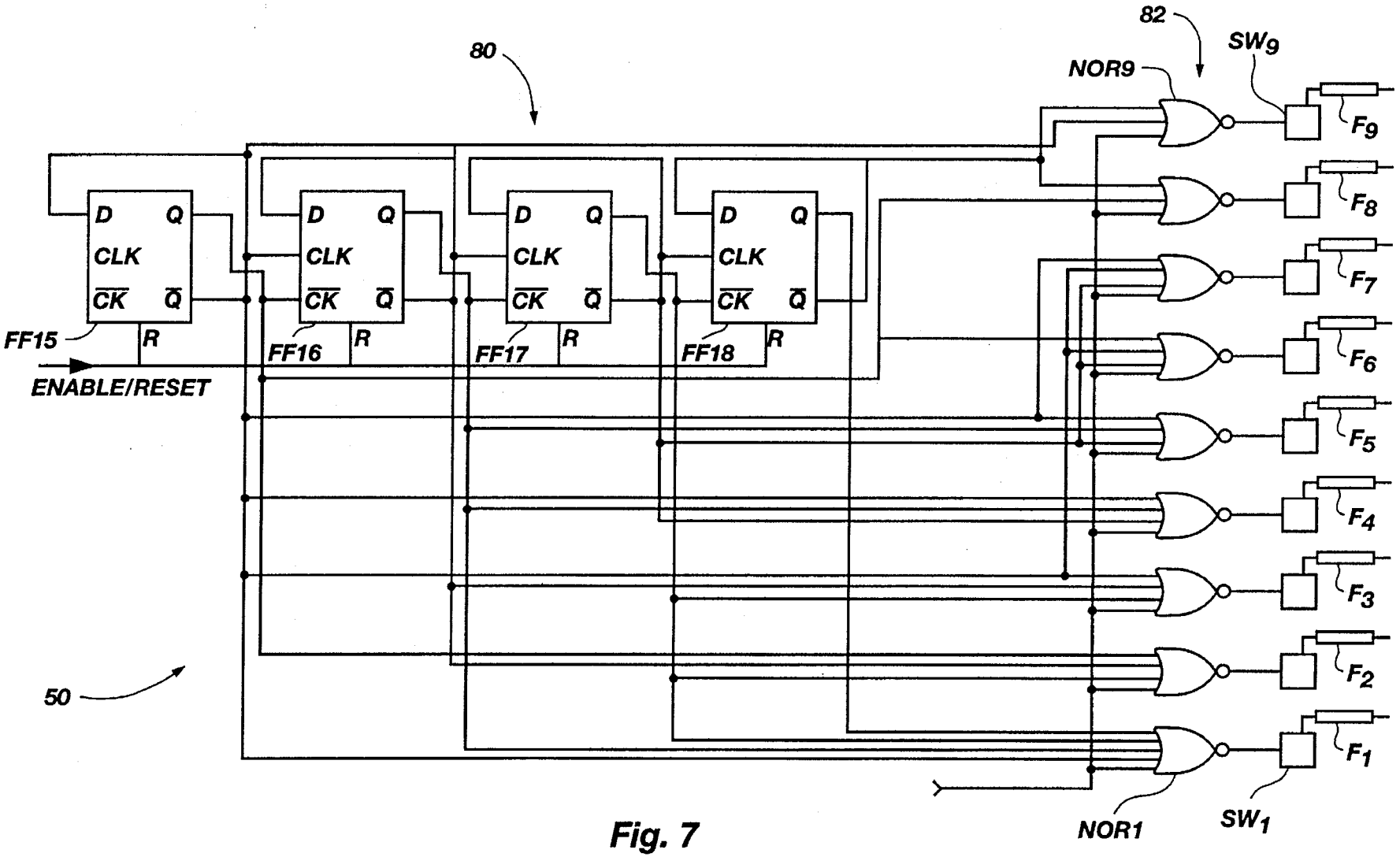
FIG. 7 is a schematic diagram of a memory write circuit, and portions of a fusible-link memory.

The attention-pulse discriminator 46 and the write/arm/fire discriminator 48 are shown in block diagram from in FIG. 6, and the memory programming circuit 50 and its associated memory 52 are shown in similar fashion in FIG. 7. As shown in FIG. 6, the attention-pulse discriminator 46 is defined by three cascaded edge-triggered flip-flops FF6, FF7, and FF8 organized in a shift register configuration having their Q outputs connected to the D input of the succeeding device and with each device receiving the CLK and inverted CLK pulses on their CK and CK(not) inputs. The Q output of the second flip-flop, FF7, is connected to an attention-pulse latch 74 that provides an appropriate enable or inhibit signal to the remaining logic devices in the event that an incoming pulse having a pulse duration longer than two-clock pulses is detected. Since a valid ATTENTION pulse has a fixed duration of 2.3 CLKS, a valid ATTENTION pulse will provide a 'latch' signal to the attention-pulse latch 74. If the incoming pulse is longer than three-clock pulses, the Q output of FF8 actuates the discharge switch 64 (i.e., a MOSFET) that is connected in circuit with the rapid-discharge resistor 62 (FIG. 4) to disarm the initiator 10 by effecting a relatively quick discharge of the firing capacitor 32 through the rapid-discharge resistor 62. Concurrently, the Q(not) output of FF8 resets the attention-pulse latch 74 to effectively inhibit the remaining logic circuitry from operation. The flip-flips FF6–FF8 effectively detect the presence of a valid 2.3 CLK ATTENTION pulse; if the incoming pulse is less than two-CLK duration, the attention-pulse latch 74 does not enable the remaining circuitry, and, if the incoming pulse is more than three-CLK duration, the circuitry is reset and the firing capacitor 32 is discharged to effectively disarm the initiator 10. While not specifically shown, the outputs of the attention-pulse latch 74 are connected to the various logic devices of the time-delay circuitry to effectively enable, inhibit, or reset those devices as necessary.

If an incoming pulse is identified as a valid ATTENTION command, the logic circuitry 30 is fully enabled to await a selected number of clock cycles for a WRITE, ARM, or FIRE command. If no pulse is detected after a selected number of clock cycles subsequent to a valid ATTENTION pulse (i.e., a total of six-clock cycles), the logic circuitry 30 undergoes an auto disarm and reset. This feature effectively presents a fixed-time window during which the WRITE, ARM, or FIRE command must be received, and, if not received, another ATTENTION pulse must be sent to restart the command sequencing. During the post-ATTENTION pulse period, the write/arm/fire discriminator 48 determines whether an incoming post-ATTENTION pulse is a WRITE, ARM, or FIRE command.

As shown in FIG. 6, the write/arm/fire discriminator 48 includes a shift register 76 defined by three cascaded D-type flip-flops FF9–FF11 in which the Q output of the preceding flip-flop connects to the D input of the subsequent flip-flop. The Q outputs of flip-flops FF9– FF11 are also connected to coincidence gates NAND1, NAND2, and NAND3 so that one of these three coincidence gates will provide an output if a signal is present when its corresponding flip-flop in the shift register 76 is being clocked. In addition to the shift register 76, the write/arm/fire discriminator 48 includes a timeout counter 78 that counts through q clock cycles and which effects a system reset if a WRITE, ARM, or FIRE command is not sensed within that time period. As shown, the timeout counter 78 is defined by a 3-bit counter that includes flip-flops FF12, FF13, and FF14. The resets of the flip-flops that define the shift register 76 and the timeout counter 78 are connected in common to selectively inhibit or enable the write/arm/fire discriminator 48. When the attention-pulse latch 74 is enabled by detection of a valid ATTENTION pulse, the shift register 76 and timeout counter 78 are concurrently enabled. The shift register 76 will be stepped through its three states by the CLK pulses as the timeout counter 78 increments through its eight possible count states. As can be appreciated, the flip-flop FF9 will be clocked during the clock cycle period during which a WRITE command would be expected, the flip-flop FF10 will then be clocked during the clock cycle period during which an FIRE command would be expected, and the flip-flop FF11 will be clocked during the clock cycle during which a ARM command would be expected. The timeout counter 78 is started concurrently with the shift register 76 and begins incrementing towards its sixth state. If a WRITE, ARM, or FIRE signal is detected by the shift register 76 and any one of the gates NAND1, NAND2, or NAND3 provides a corresponding output, the timeout counter 78 is inhibited. Conversely, if no WRITE, ARM, or FIRE command is received, the timeout counter 78 effects a system power-on reset (POR) after it times out.

If a WRITE signal is present during the appropriate clock cycle, the gate NAND1 will provide a 'write enable' signal to the memory programming circuit 50, discussed below in relation to FIG. 7. If an ARM signal is present during the appropriate clock cycle, the gate NAND2 will provide an 'arm' signal to the arming circuit 54, and, lastly, if a FIRE signal is present during the appropriate clock cycle, the gate NAND3 will provide a 'fire' signal to the fire-command circuit 56, discussed below in relation to FIG. 8.

The memory programming circuit 50 is shown in block form in FIG. 7 and consists of four D-type flip-flops FF15, FF16, FF17, and FF18 organized as a 4-bit 1-of-16 counter 80 that counts the successive CLK pulses subsequent to the detection of a valid ATTENTION followed by a valid WRITE command. The Q and Q(not) outputs of the counter 80 are connected to a decoder 82 having nine NOR gates, NOR1 . . . NOR9, that accept both the programming pulses subsequent to the WRITE command and the output state of the counter 80. Since only nine bits are necessary to specify the 1-of-512 clock pulses, only the first nine states of the counter 80 are necessary, along with the programming pulses, to provide an output on any one of the nine NOR gates NOR1–NOR9 of the decoder 82. The output of the individual NOR gates NOR1 . . . NOR9 are connected to respective current switches SW1 . . . SW9 (i.e., MOSFETS) that pull a current through a respective one of nine fusible links F1 . . . F9. The application of the programming current through any of the nine fusible links F1 . . . F9 causes that link to open. Accordingly, the nine fusible links F1 . . . F9, when programmed, represent the desired time delay. In the preferred embodiment, the fusible links F1 . . . F9 are formed on the substrate of the ASIC from a silicon-chrome silicide.

Figure 8:
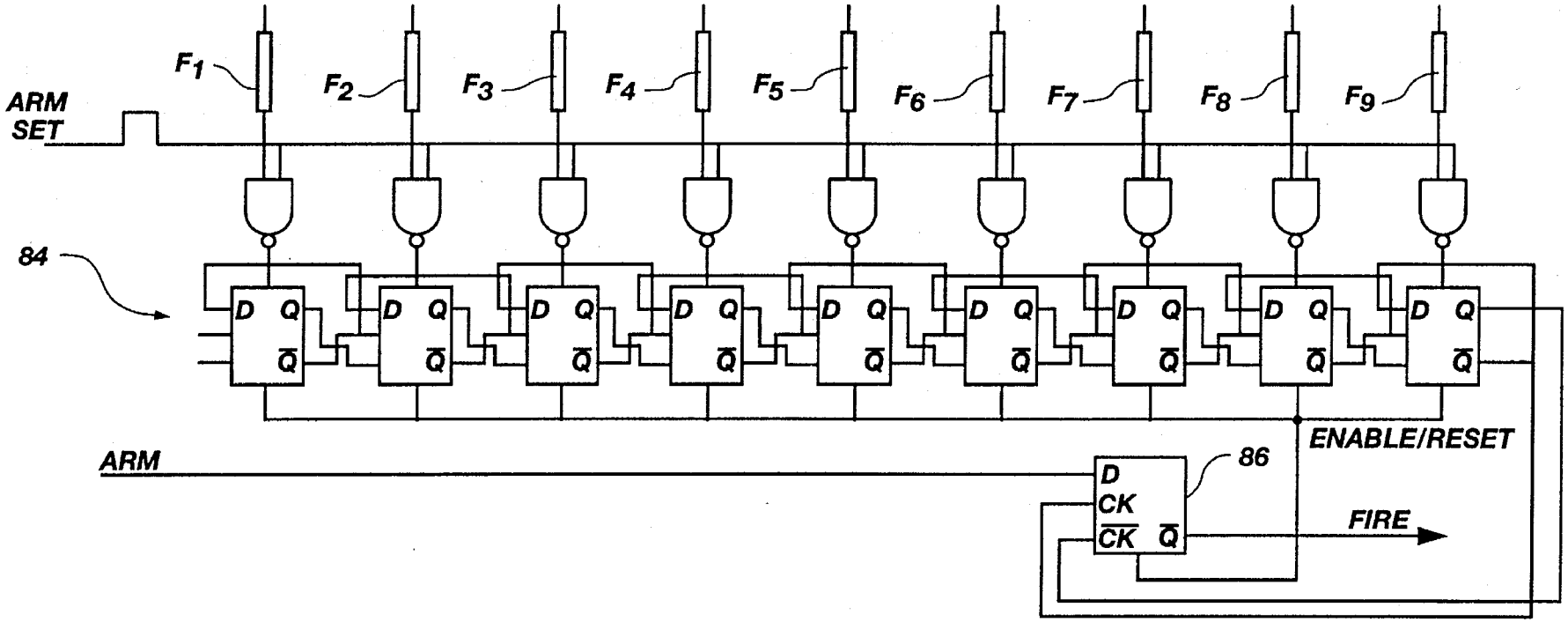
FIG. 8 is a schematic diagram of a fire control counting circuit.

If an ARM command, rather than the WRITE command, is detected by the write/arm/fire discriminator 48, the gate NAND3 sets an arm latch which, in turn, sends a set command to the memory to read the memory in FIG. 8 (described below), and applies the input power provided along the input leads L1 and L2 to the firing capacitor 32 through the now-closed switch 58 (FIG. 4). The firing capacitor 32 is thus provided with a sufficient charge to fire the bridge initiator 18. Since the firing capacitor 32 will draw a relatively substantial current when charging is initiated, the blasting machine 14 can monitor the current to determine when the firing capacitor 32 is fully charged. The voltage sensor 66 is also connected across the firing capacitor 32 and, in the preferred form, provides a signal indicating that the firing capacitor 32 is at-voltage or not at-voltage. As mentioned above, 'not at-voltage' signal is available to inhibit the fire circuit.

If a FIRE command is detected by the logic circuitry 30, the fire-control counter 84 starts counting. As shown in FIG. 8, the fire-control counter 84 is organized as nine D-type flip-flops (unnumbered) in a counter configuration with the count limited by the open or unopened state of the various fusible links F1 . . . F9. Once the fire-control counter 84 counts out (as controlled by the pre-programmed fusible links), the logic state of the fire-control latch 86 is switched to gate a switch (i.e., a MOSFET) that triggers the SCR 34. Once triggered, the SCR 34 shunts the pre-stored charge in the firing capacitor 32 through the bridge initiator 18. In response to the application of this firing current, the bridge initiator 18 transitions rapidly to a plasma state to initiate the explosive charge 20.

The present invention advantageously provides a programmable electronic time delay initiator in which the time delay can be programmed by a command transmitter at any time subsequent to manufacture including programming just prior to use in the field using a serial command-and-control paired-pulse protocol that can be delivered over a two-wire pathway. Highly accurate clock pulses are provided by a piezoelectric resonator that cooperates with an RC oscillator circuit that will provide pulses in the event that operation of the piezoelectric resonator is momentarily interrupted or halted by vibration and/or shock from an adjacent, preceding explosion.

As will be apparent to those skilled in the art, various changes and modifications may be made to the illustrated programmable electronic time delay initiator of the present invention without departing from the spirit and scope of the invention as determined in the appended claims and their legal equivalent.

What is claimed is:

1. A programmable electronic time delay initiator comprising:

an electrically actuatable initiator for initiating an explosive in response to an electric current flow therethrough;

controllable circuit means for actuating said initiator in response to command signals, said circuit means including:

a command signal discriminator for discriminating between command signals, said command signal discriminator identifying as a valid command an initial pulse having a selected pulse characteristic and at least one other pulse occurring a selected time period subsequent to said initial pulse; and a programmable multi-bit memory for storing a binary value corresponding to a selected time delay, said memory comprising a plurality of fusible links corresponding to respective bit values.

2. The programmable electronic time delay initiator of claim 1, in which said at least one other pulse is in a third time period subsequent to said initial pulse, said command signal discriminator identifying said initial pulse and the other pulse as a third separate command signal.

3. The programmable electronic time delay initiator of claim 1, wherein one of said command signals further comprises a sequence of binary values following said other pulse, said sequence of binary values corresponding to the respective bit values of said memory.

4. The programmable electronic time delay initiator of claim 3, wherein said circuit means includes means to change the bits of said multi-bit memory to thereby store said binary value corresponding to said selected time delay.

5. The programmable electronic time delay initiator of claim 1, wherein said circuit means includes means to apply a current through selected ones of said fusible links in a manner corresponding to the binary values of the sequence of binary values to open the selected ones of said fusible links.

6. The programmable electronic time delay initiator of claim 5, wherein said fusible links comprise a siliconchrome alloy deposited upon a substrate.

7. The programmable electronic time delay initiator of claim 1, wherein said circuit means further comprises a charge storing means and means for applying a charge to said charge storing means in response to one of said command signals.

8. The programmable electronic time delay initiator of claim 7, wherein said circuit means includes means for switching an electrical charge stored on said charge storing means to said initiator in response to another of said command signals.

9. The programmable electronic time delay initiator of claim 7, further comprising an impedance connected across said charge storing means to effect continuous discharge thereof.

10. The programmable electronic time delay initiator of claim 7, further comprising a serially connected switch and impedance connected across said charge storing means to effect selective discharge thereof.

11. The programmable electronic time delay initiator of claim 7, further comprising means connected across said charge storing means to determine if said charge storing means is at-voltage or not-at-voltage.

12. The programmable electronic time delay initiator of claim 1, wherein said circuit means further comprises a binary counter for counting a binary value corresponding to said stored binary value.

13. The programmable electronic time delay initiator of claim 12, wherein said circuit means further comprises means for supplying a sequence of clock pulses to said counter.

14. The programmable electronic time delay initiator of claim 13, wherein said means for supplying a sequence of clock pulses to said counter comprises an oscillator circuit driven by a crystal resonator and an RC resonator, the RC resonator circuit continuing to drive the oscillator in the event the crystal resonator becomes inoperative.

15. The programmable electronic time delay initiator of claim 13, wherein said circuit means includes means for starting said counter to count in response to a one of said command signals.

16. The programmable electronic time delay initiator of claim 1, further comprising a switch means for selectively connecting or disconnecting the initiator from a source of said command signals.

17. A programmable electronic time delay initiator comprising:

an electrically actuatable initiator for initiating an explosive in response to an electric current flow therethrough;

means for storing an electrical charge sufficient to initiate said initiator;

controllable switch means for switching the stored electrical charge to said initiator;

means for memorizing a multi-bit binary value;

circuit means including a command signal discriminator for discriminating between a WRITE, ARM, and FIRE commands, each of said commands defined by a first pulse of a selected duration followed by a subsequent other pulse occurring within a first, second, or third time period following said first pulse.

18. The programmable electronic time delay initiator of claim 17, wherein said WRITE command is followed by a sequence of binary bits defining a selected time delay.

19. The programmable electronic time delay initiator of claim 18, wherein said circuit means further comprises a programmable multi-bit memory and means to change the bits of said multi-bit memory to thereby store a binary value corresponding to a selected time delay.

20. The programmable electronic time delay initiator of claim 19, wherein said means for memorizing comprises a plurality of fusible links corresponding to respective bits of said multi-bit memory.

21. The programmable electronic time delay initiator of claim 20, wherein said fusible links comprise a siliconchrome alloy deposited upon a substrate.

22. The programmable electronic time delay initiator of claim 20, wherein said circuit means includes means to apply a current through selected ones of said fusible links in a manner corresponding to the binary values of the sequence of binary values to open the selected ones of said fusible links.

23. The programmable electronic time delay initiator of claim 19, wherein said circuit means further comprises a binary counter for counting a binary value corresponding to said stored binary value.

24. The programmable electronic time delay initiator of claim 23, wherein said circuit means further comprises means for supplying a sequence of clock pulses to said counter.

25. The programmable electronic time delay initiator of claim 24, wherein said circuit means includes means for starting said counter to count in response to said FIRE command signal.

26. The programmable electronic time delay initiator of claim 24, wherein said means for supplying a sequence of clock pulses to said counter comprises an oscillator circuit driven by a crystal resonator and an RC resonator, the RC resonator circuit continuing to drive the oscillator in the event the crystal resonator becomes inoperative.

27. The programmable electronic time delay initiator of claim 17, wherein said circuit means further comprises means for applying a charge to said charge storing means in response to said ARM command signal.

28. The programmable electronic time delay initiator of claim 17, further comprising an impedance connected across said charge storing means to effect continuous discharge thereof.

29. The programmable electronic time delay initiator of claim 17, further comprising a serially connected switch and impedance connected across said charge storing means to effect selective discharge thereof.

30. The programmable electronic time delay initiator of claim 17, further comprising means connected across said charge storing means to determine if said charge storing means is at-voltage or not-at-voltage.

31. The programmable electronic time delay initiator of claim 17, a switch means for selectively connecting or disconnecting the initiator from a source of command signals.

32. A programmable electronic time delay initiator comprising:

an electrically actuatable initiator for initiating an explosive in response to an electric current flow therethrough;

controllable circuit means for actuating said initiator in response to command signals, said circuit means including:

a command signal discriminator for discriminating between command signals, said command signal discriminator identifying as a valid command an initial pulse having a selected pulse characteristic and at least one other pulse occurring a selected time period subsequent to said initial pulse;

a binary counter for counting a binary value; and pulse supply means for supplying a sequence of clock pulses to said counter, said pulse supply means comprising an oscillator circuit driven by a crystal resonator and an RC resonator, the RC resonator circuit continuing to drive the oscillator in the event the crystal resonator becomes inoperative.

33. The programmable electronic time delay initiator of claim 32, wherein said circuit means includes means for starting said counter to count in response to one of said command signals.

* * * * *